US007775406B2

(12) United States Patent
Foster et al.

(10) Patent No.: US 7,775,406 B2
(45) Date of Patent: Aug. 17, 2010

(54) TRIGGER SPRAYER WITH VENTING MEMBRANE IN PROTECTIVE HOUSING CAVITY

(75) Inventors: Donald D. Foster, St. Charles, MO (US); Jeffrey P. Stark, Wentzville, MO (US)

(73) Assignee: Meadwestvaco Calmar, Inc., Grandview, MO (US)

( * ) Notice: Subject to any disclaimer, the term of this patent is extended or adjusted under 35 U.S.C. 154(b) by 1203 days.

(21) Appl. No.: 11/127,966

(22) Filed: May 12, 2005

(65) Prior Publication Data

US 2006/0255075 A1 Nov. 16, 2006

(51) Int. Cl.
*B67D 7/58* (2010.01)

(52) U.S. Cl. ..... 222/383.1; 222/189.09; 222/481.5; 239/333

(58) Field of Classification Search ..... 222/189.09, 222/383.1, 481.5; 239/333
See application file for complete search history.

(56) References Cited

U.S. PATENT DOCUMENTS

| | | | | |
|---|---|---|---|---|
| 4,669,664 | A * | 6/1987 | Garneau | 239/333 |
| 5,244,126 | A * | 9/1993 | Geier | 222/383.1 |
| 5,752,629 | A | 5/1998 | Hardy | |
| 5,901,867 | A | 5/1999 | Mattson | |
| 5,927,559 | A * | 7/1999 | Bommer et al. | 222/189.09 |
| 6,073,812 | A * | 6/2000 | Wade et al. | 222/189.09 |
| 6,257,455 | B1 * | 7/2001 | Trepina et al. | 222/189.09 |

* cited by examiner

*Primary Examiner*—Frederick C. Nicolas
(74) *Attorney, Agent, or Firm*—MWV Intellectual Property Group

(57) ABSTRACT

A trigger sprayer is provided with a passive venting system of simplified and inexpensive construction. A gas permeable, liquid impermeable membrane is positioned over a vent opening in the trigger sprayer housing and prevents the leakage of liquid from a container attached to the trigger sprayer, while allowing the venting of air from the exterior of the trigger sprayer to the container interior. The membrane is secured to a vent opening surface of the sprayer housing that is surrounded by a vent side wall that protects the vent membrane.

20 Claims, 3 Drawing Sheets

TRIGGER SPRAYER WITH VENTING MEMBRANE IN PROTECTIVE HOUSING CAVITY

BACKGROUND OF THE INVENTION (1) Field of the Invention

The present invention pertains to a trigger sprayer which is connectable to a separate liquid container, where the trigger sprayer has a trigger that is manually manipulated to pump liquid from the container, and dispense the liquid from the trigger sprayer as a spray, stream, or foam.

In particular, the present invention pertains to a venting membrane that is secured in the trigger sprayer to permit venting of air into the interior volume of the container as liquid is dispensed from the container, where the membrane is positioned in a cavity of the sprayer housing that protects the membrane.

(2) Description of the Related Art

The present invention pertains to a trigger sprayer which is connectable to a separate container containing a liquid. The trigger sprayer has a trigger that is manually manipulated to operate a pump in the trigger sprayer. The pump draws liquid from the liquid container, through the trigger sprayer, and dispenses the liquid from the trigger sprayer as a spray, stream, or foam.

There are many different systems employed in the construction of conventional trigger sprayers that allow for the venting of air to the interior of the liquid container connected to the trigger sprayer. The venting systems of trigger sprayers allow air to enter the container and occupy the container internal volume vacated by liquid dispensed from the container by the trigger sprayer. Venting of the container interior volume is required because the connection between the container and the trigger sprayer is typically a fluid-tight connection. This prevents the inadvertent leakage of the liquid contents of the container should the container and attached trigger sprayer be inverted or positioned on their sides. The fluid-tight connection between the container and the trigger sprayer is typically provided by a gasket positioned between the upper rim of a neck of the container and a bottom annular surface of the trigger sprayer housing. The connector that attaches the trigger sprayer to the container compresses the gasket between the container neck and the annular surface of the trigger sprayer housing, thereby providing the fluid-tight seal between the trigger sprayer and the container. However, the fluid-tight seal between the trigger sprayer and the container makes it difficult to vent the interior of the container as liquid is dispensed from the container. To maintain the fluid-tight connection between the trigger sprayer housing and the container, prior art venting systems have required elaborate constructions that add to the manufacturing costs of the trigger sprayer.

For example, one typical venting system employs a resilient diaphragm valve that covers a vent hole in the sprayer housing that communicates the interior of the container with the container exterior environment, and a plunger connected to the trigger of the trigger sprayer. On manipulation of the trigger, the plunger is inserted through the sprayer housing vent hole and presses against the diaphragm valve, moving the diaphragm valve away from the vent hole and thereby venting the interior of the container. This type of venting system has been found to be disadvantaged in that the resiliency of the material of the diaphragm often does not enable the diaphragm valve to immediately position itself over the vent hole when the plunger is retracted. This can result in liquid leaking from the container through the vent hole. Providing the resilient diaphragm valve and the plunger in the trigger sprayer construction also increases the cost of construction.

Another prior art venting system employs a small vent piston that reciprocates with the trigger and the pump piston of the trigger sprayer. The vent piston reciprocates in a vent chamber formed in the sprayer housing. As the vent piston is pushed into the vent chamber, the piston uncovers a vent hole that allows the container interior to be vented to the exterior environment. As the vent piston is pulled through the vent chamber and covers the vent hole, the container interior is again sealed from the exterior environment. The constructions of the these types of venting systems require that the sprayer housing be formed with an additional vent chamber, and that the trigger and/or pump piston be formed with an additional vent piston, increasing the manufacturing costs of the trigger sprayer.

What is needed to overcome these disadvantages of prior art trigger sprayers is a venting system that enables the interior of the container connected to the trigger sprayer to be vented, while maintaining the gasket fluid-tight seal between the trigger sprayer and without appreciably increasing the manufacturing costs of the trigger sprayer.

SUMMARY OF THE INVENTION

The construction of the trigger sprayer of the present invention overcomes the aforesaid disadvantages typically associated with prior art trigger sprayers by providing a trigger sprayer housing with a passive venting system that does not require movable parts and their associated costs. The venting system of the invention comprises a vent hole in the trigger sprayer housing that vents air to the interior volume of the container attached to the trigger sprayer, where the vent hole is covered by a gas permeable, liquid impermeable membrane.

Trigger sprayers employing venting membranes have been known. These prior art sprayers are disadvantaged in that the membrane could be dislodged from the sprayer housing if contacted by other sprayers during manufacturing and shipping of the sprayers.

The vent hole and membrane of the sprayer of the invention are positioned in a cavity recessed into the sprayer housing where the membrane is protected. This novel construction enables the sprayer housing to be economically manufactured, while allowing the sprayer housing to vent the interior volume of the container attached to the trigger sprayer, while maintaining the fluid-tight seal between the trigger sprayer and the container, and while protecting the membrane.

The trigger sprayer of the invention is comprised of a housing constructed in two separate sections, a pump section and a vent section. The pump section and the vent section are constructed so that these two sections can be press fit or snap fit together in assembling the trigger sprayer.

The housing pump section contains the component parts of the trigger sprayer that can be found in many conventional trigger sprayers. This housing section contains the pump chamber , as well as the liquid supply passage and the liquid discharge passage that communicate with the pump chamber. The bottom of the housing pump section has an opening dimensioned to receive the housing vent section.

The vent section of the housing has a generally cylindrical configuration that is complementary to an interior configuration of the bottom opening of the housing pump section. This enables the two sections to be press fit or snap fit together by inserting the vent section into the pump section. A liquid supply tube extends through the vent section and communicates with the liquid supply passage of the housing pump section. A dip tube is attached to the liquid supply tube and extends into the liquid container attached to the trigger sprayer. A circular flange with an annular surface surrounds a bottom opening of the housing vent section. The annular surface is positioned on the housing vent section to engage against a gasket positioned between the trigger sprayer and the neck of the liquid container to which the trigger sprayer is attached. A cavity is recessed into the housing vent section from the annular surface, and a vent surface is positioned at the bottom of the cavity. The cavity has a side wall that surrounds the cavity. The vent surface has a vent opening that communicates and vents the interior of the container attached to the trigger sprayer with the exterior environment of the trigger sprayer.

A membrane is secured to the vent surface covering over the vent opening. The membrane is a gas pervious/liquid impervious membrane. The cavity side wall protects the membrane. Thus, the membrane allows air to pass the exterior of the trigger sprayer, through the membrane to the container interior, but prevents the passage of liquid from the container interior through the membrane and the vent opening.

The gasket is a flat, circular disk of typical gasket material. The gasket has a circular peripheral edge that matches the circular peripheral edge of the annular surface of the housing vent section. A liquid supply hole is positioned on the gasket to accommodate the dip tube of the trigger sprayer extending through the liquid supply hole. The gasket extends over the cavity that contains the vent membrane, but a bypass opening in the cavity side wall bypasses the gasket and communicates the container interior with the vent hole. The gasket covering the vent membrane provides further protection to the membrane.

The novel configuration of the trigger sprayer housing provides the trigger sprayer with a passive venting system of simplified and inexpensive construction. The membrane employed over the vent opening prevents the leakage of liquid from the container through the trigger sprayer, while allowing the venting of air from the exterior of the trigger sprayer to the container interior. The positioning of the vent opening and the vent membrane inside a cavity in the sprayer housing protects the membrane. Thus, the combination of these features provides a trigger sprayer that is economically manufactured, provides a fluid-tight seal between the trigger sprayer and the liquid container, and prevents the leakage of liquid from the container while allowing container venting and while protecting the vent membrane.

BRIEF DESCRIPTION OF THE DRAWINGS

Further objects and features of the invention are set forth in the following detailed description of the preferred embodiment of the invention and in the drawing figures wherein.

DETAILED DESCRIPTION OF THE PREFERRED EMBODIMENT

Figure 1:
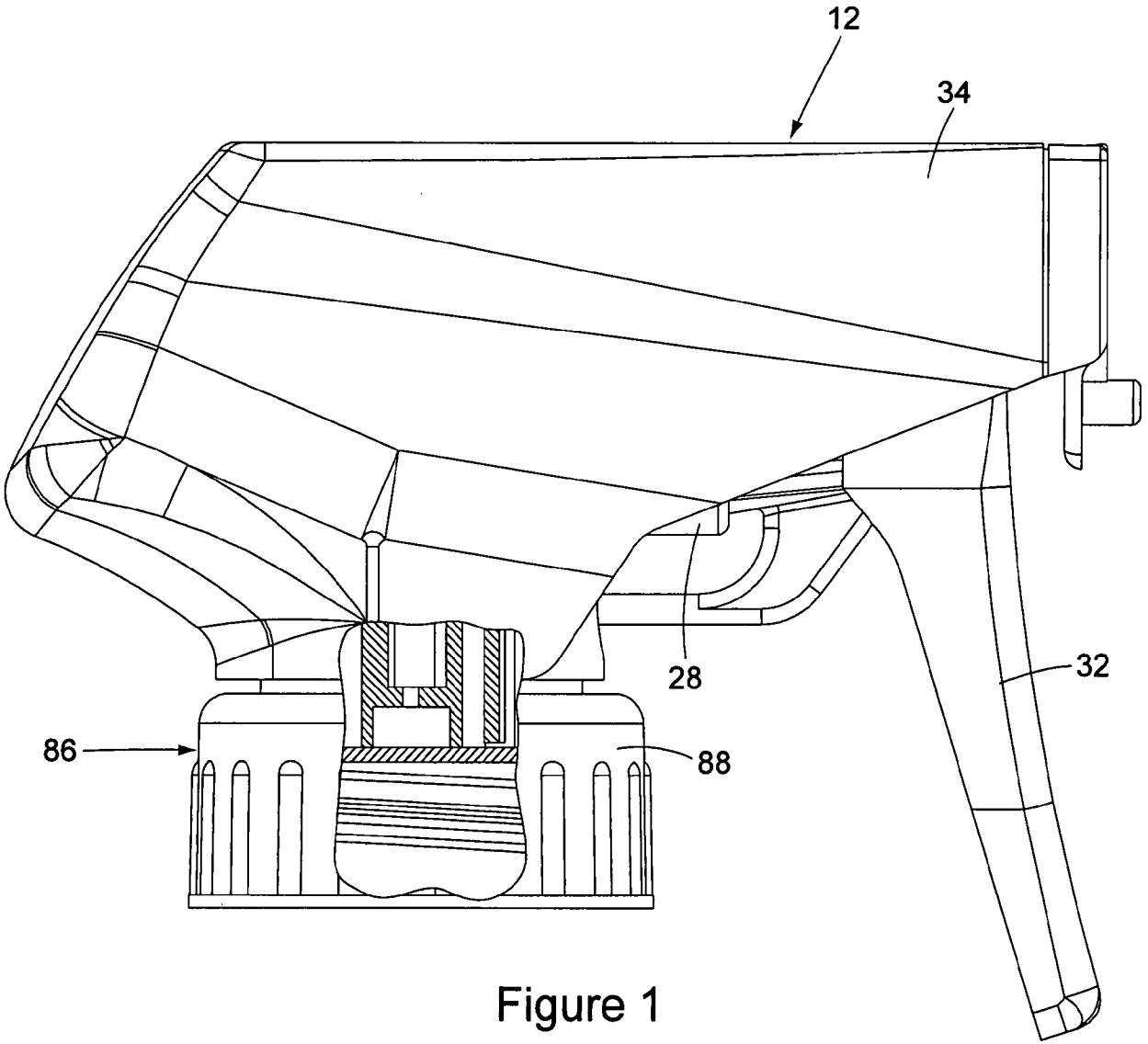
FIG. 1 is a side view of the trigger sprayer of the invention with a portion of trigger sprayer broken away.
Figure 2:
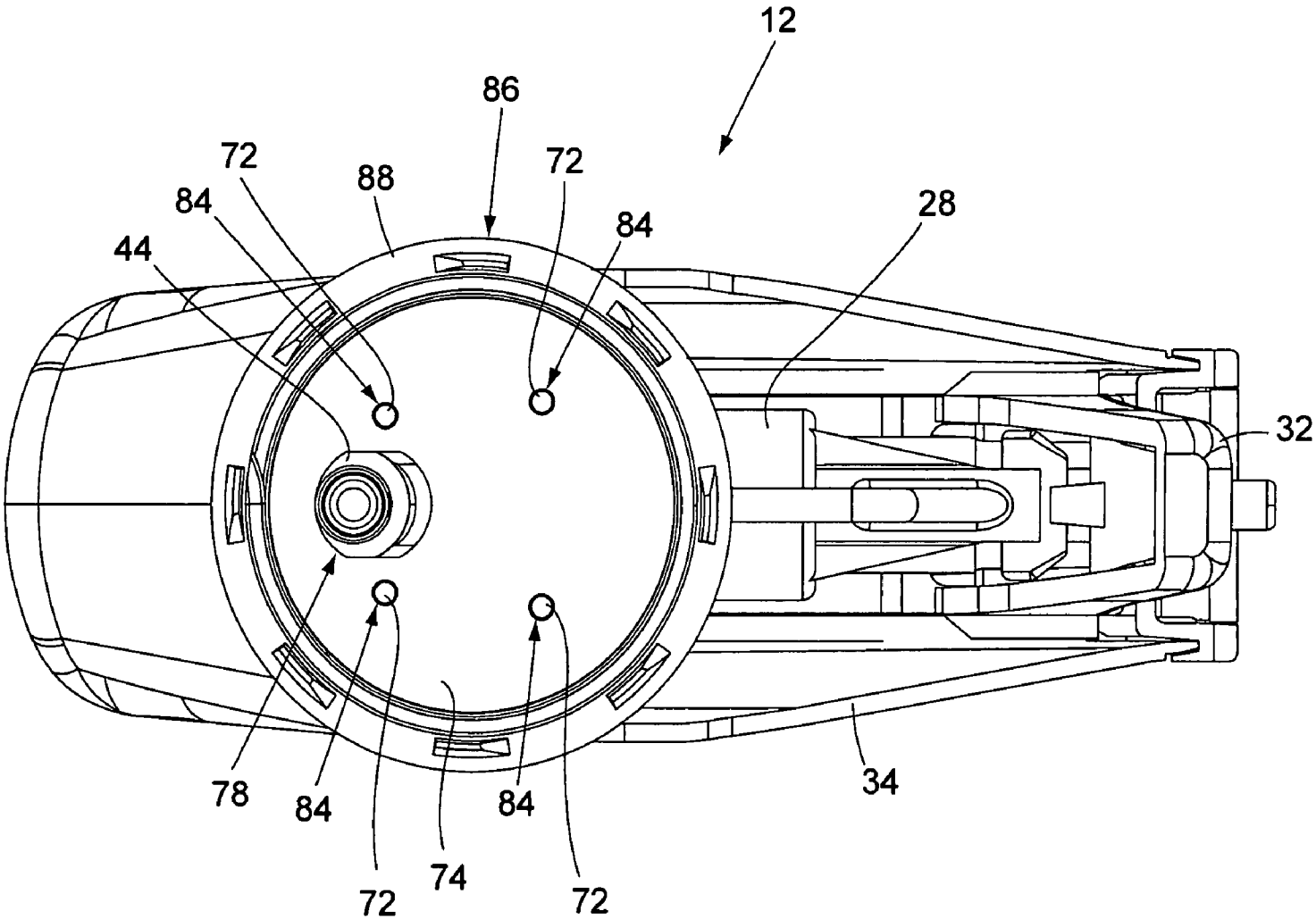
FIG. 2 is a bottom plan view of the trigger sprayer.
Figure 3:
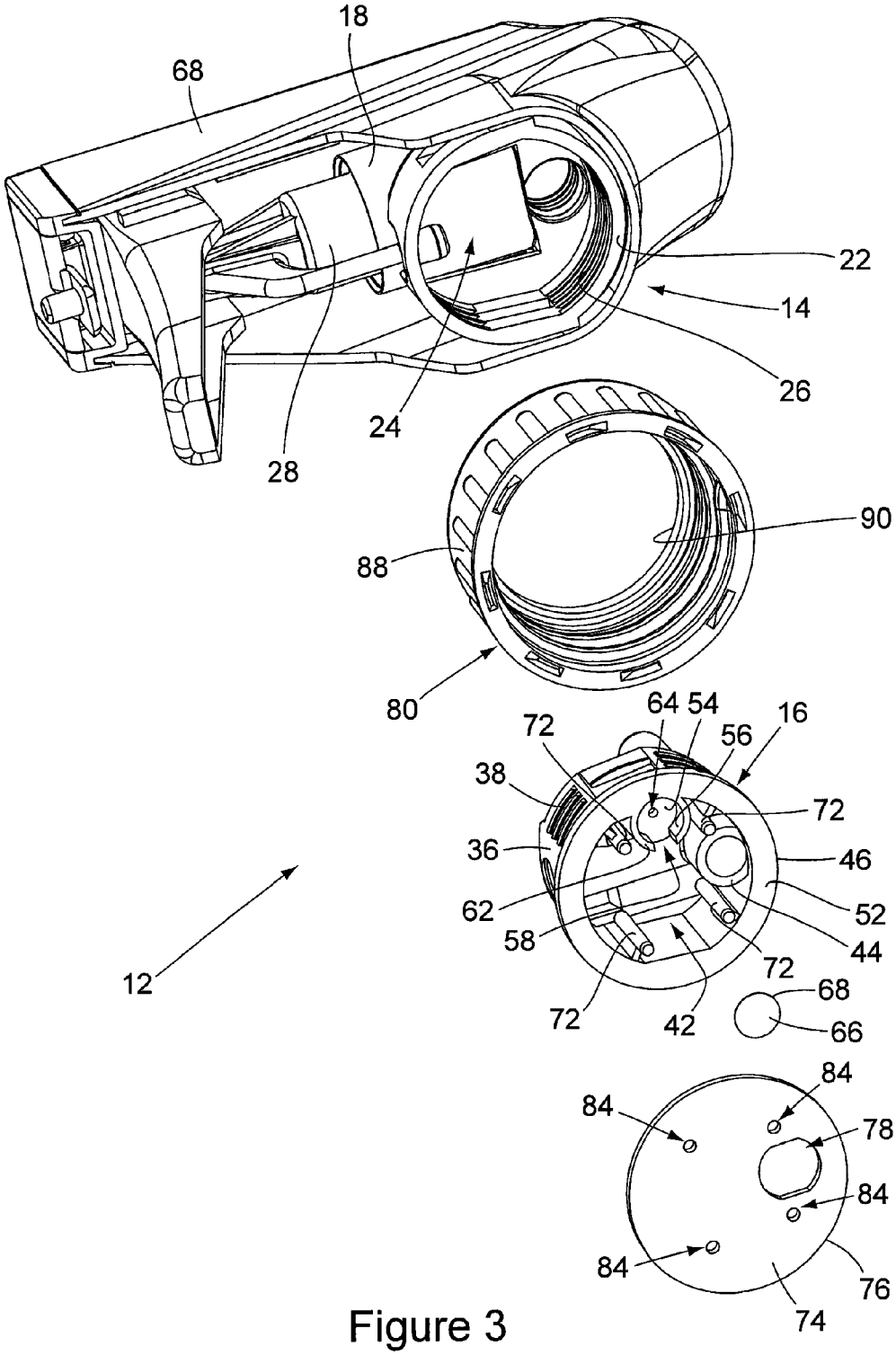
FIG. 3 is an exploded view of several of the component parts of the trigger sprayer.

FIGS. 1-3 of the application show a trigger sprayer that is similar in construction to the trigger sprayers disclosed in the Foster U.S. Pat. Nos. 5,344,053 and 5,337,928, the disclosures of which are incorporated herein by reference. The passive venting system of the invention will be described as being employed in a trigger sprayer of the type disclosed in the above referenced patents. However, it should be understood that the venting system of the invention may be employed in a variety of different trigger sprayer constructions, as well as vertically reciprocating liquid dispensers. The particular construction of the trigger sprayer disclosed herein is intended to be illustrative of one environment in which the venting system may be used, and is not intended as being limiting. Because the venting system of the invention may be used in a variety of different types of liquid dispensers, the component parts of the trigger sprayer that are not material to the construction and operation of the venting system of the invention will be described generally herein.

As stated earlier, the construction of the trigger sprayer of the present invention overcomes disadvantages typically associated with prior art trigger sprayers by providing a trigger sprayer housing with a vent hole that vents air to the interior volume of the container attached to the trigger sprayer, where the vent hole is covered by a gas permeable, liquid impermeable membrane. The vent hole and membrane cover are positioned within a cavity side wall on the sprayer housing to enable the sprayer housing to be economically manufactured with a passive venting system, i.e., having no moving parts. The passive venting system allows the trigger sprayer to vent the interior volume of the container attached to the trigger sprayer, and while maintaining a fluid tight seal between the trigger sprayer and the container.

Referring to the drawing figures, the trigger sprayer 12 of the invention is comprised of a housing constructed in two separate sections, a pump section 14 and a vent section 16. As their names suggest, the housing pump section 14 contains the pump of the trigger sprayer, and the housing vent section 16 contains the venting system of the invention. The pump section 14 and the vent section 16 are constructed so that they can be press fit or snap fit together in assembling the trigger sprayer 12. To facilitate this assembly, the two housing sections 14, 16 are constructed of a resilient plastic material typically used in the construction of trigger sprayers.

The housing pump section 14 contains the component parts typically found in a conventional trigger sprayer. Because these component parts are well known, they are described generally. The housing pump section 14 contains a pump chamber 18, a liquid discharge passage (not shown) that communicates with and extends away from the pump chamber, and a liquid supply passage (not shown) that communicates with and extends to the pump chamber. The bottom of the housing pump section 14 has a generally cylindrical wall 22. The wall 22 surrounds a bottom access opening 24 to the interior of the pump section. The pump section wall 22 has a plurality of internal ribs 26 on an interior surface of the wall. The ribs 26 project into the bottom opening 24 of the pump section wall 22 and provide a portion of the press fit or snap fit connection between the pump section 14 and the vent section 16. The pump section bottom opening 24 is dimensioned to receive the vent section 16 therein, in assembling the vent section to the pump section.

As in conventional trigger sprayers, a pump piston 28 is assembled into the pump chamber 18 of the housing pump section 14. The pump piston 28 is mounted for reciprocating movement in the pump chamber 18.

A trigger 32 is mounted to the housing pump section 14 by a pivot connection (not shown) between the trigger and the pump section. The pivot connection allows the trigger 32 to be manually manipulated or oscillated on the pump section 14. The trigger 32 is operatively connected with the pump piston 28 and causes the pump piston to reciprocate in the pump chamber 18 in response to oscillating movements of the trigger 32 on the pump section 14. As in the operation of conventional trigger sprayers, the manipulation of the trigger 32 and the reciprocation of the pump piston 28 draws liquid from a separate liquid container attached to the trigger sprayer 12 into the pump chamber 18, and dispenses the liquid from the trigger sprayer.

A shroud 34 is assembled on the housing pump section 14. The shroud 34 is designed to give the trigger sprayer 12 an aesthetically pleasing appearance to consumers.

The housing vent section 16 has a cylindrical wall 36 with a plurality of arcuate ridges 38 projecting outwardly from the wall. The arcuate ridges 38 are designed to mate with the internal ribs 26 of the housing pump section 14 to press fit or snap fit the vent section 16 in the pump section interior. The vent section wall 36 surrounds a hollow interior volume 42 of the housing vent section 16. A liquid supply tube 44 extends through the vent section 16. An upper portion of the tube 44 communicates with the pump chamber 18 when the vent section 16 is assembled into the pump section 14, thereby establishing the liquid supply passage through the trigger sprayer 12. A lower end of the tube 44 communicates with a dip tube (not shown) that extends into the interior of the liquid container to which the trigger sprayer 12 is attached. This communicates the pump chamber 18 with the liquid contained in the liquid container.

A circular flange 46 projects outwardly from the bottom of the vent section wall 36. The flange 46 has a circular peripheral edge surface and a flat, annular bottom surface 52 at the bottom of the housing vent section 16. The annular surface 52 surrounds a bottom opening that provides access to the interior 42 of the vent housing section.

The vent housing section 16 has a vent surface 54 that is recessed in the housing section from the annular flange surface 52. The vent surface 54 is circular, and is surrounded by a cylindrical side wall 56 that defines a cavity that extends into the housing vent section 16 from the annular surface 52. The side wall 56 has a small opening 58. The side wall 56 extends outwardly from the vent surface 54 to an end edge 62 of the side wall. The end edge 62 has a C-shape from the side wall opening 58. The end edge 62 of the side wall is coplanar and continuous with the flange annular surface 52 of the housing vent section 16.

A vent opening 64 extends through the vent surface 54. The vent opening 64 communicates the exterior environment of the sprayer 12 with the interior of a liquid container attached to the sprayer, thus venting the container interior.

A membrane 66 is positioned inside the cavity defined by the vent side wall 56. The membrane 66 is positioned against and secured to the vent surface 54 covering over the vent opening 64. As seen in the drawing figures, the membrane 66 has a circular peripheral edge 68 that coincides with the cylindrical interior surface of the vent side wall 56. The membrane 66 is a flat disc of material that is gas permeable and liquid impermeable. Thus, the membrane 66 allows gas to pass from the trigger sprayer exterior environment, through the membrane 66 and through the vent opening 54 to the container interior, but prevents the passage of liquid from the container interior through the membrane 66 and the vent opening 54. In the preferred embodiment of the invention, the material of the membrane 66 is polytetrafluorotehylene (PTFE). Other equivalent materials may be used for the membrane 66. In the preferred embodiment, the membrane 66 is secured to the vent surface 54 and/or the interior surface of the vent side wall 56 by radio frequency (RF) welding to the surface. The membrane 66 could be secured to either surface 54, 56 by other equivalent methods.

The membrane 66 being positioned on the vent surface 54 inside the cavity defined by the vent side wall 56 protects the membrane 66 from coming into contact with component parts of other trigger sprayers during manufacturing and shipping of the trigger sprayers. This prevents the inadvertent dislodging or separation of the membrane 66 from its position over the vent opening 58 due to the contact with component parts of other trigger sprayers.

The housing vent section 16 also comprises a plurality of posts 72 that extend from an interior surface of the vent section 16 through the vent section interior 42. The plurality of posts 72 project outwardly through the bottom opening of the housing vent section 16 and are surrounded by the annular surface 52. As seen in FIG. 3, the plurality of posts 72 are spaced inwardly from the annular surface 52 and are spatially arranged around the surface.

A gasket 74 is secured to the housing vent section 16. The gasket 74 is constructed of typical gasket material, and is constructed as a flat disk having a circular peripheral edge 76. The dimension of the gasket peripheral edge 76 matches the dimension of the vent section circular flange 46. This enables the gasket 64 to cover over and engage against the flat annular surface 52 of the vent section 16, as wells as over the end edge 62 of the vent side wall 56. In this way the gasket provides additional protection to the vent membrane 66.

A plurality of holes pass through the gasket. These include a liquid supply hole 78 that is positioned on the gasket to accommodate the dip tube of the trigger sprayer extending through the liquid supply hole 78 and into the liquid in a container attached to the trigger sprayer 12. The preferred embodiment of the gasket 74 is also provided with a plurality of post holes 84. The post holes 84 are positioned on the gasket 74 to receive the vent section posts 72 and hold the gasket against the annular surface 52 of the housing vent section 16. The liquid supply hole 68 and the post holes 84 are all separate from each other and are positioned at relative positions inside the peripheral edge 76 of the gasket 74. The posts 72 extending into the gasket 74 stake the gasket on the housing vent section annular surface 52 with the membrane 66 positioned between the gasket 74 and the vent surface 54. In an alternate embodiment, the gasket 64 could be provided with only the liquid supply hole 68. This embodiment of the gasket would be staked on the housing vent section 16 by pressing the gasket on the ends of the post 72, thereby staking the gasket on the housing vent section. In either embodiment, the gasket 74 is secured to the housing vent section 16 by the posts 72 extending into post holes 84 in the gasket.

As stated earlier, the gasket 74 attached to the housing vent section 16 engages in a sealing engagement against the flat annular surface 52. This provides a seal between the trigger sprayer 12 and a liquid container attached to the trigger sprayer. The gasket 74 also extends over and engages with the vent side wall end edge 62, thereby providing additional protection to the membrane 66 contained inside the cavity defined by the side wall 56. The vent side wall 56 is provided with the opening 58 to provide a passageway of venting air from the exterior of the trigger sprayer 12, through the vent opening 64 and the membrane 66, and through the side wall opening 58 to the container interior in venting the container.

A cap 86 having a cylindrical side wall 88 is positioned on the housing vent section 16 prior to its attachment to the housing pump section 14. The cap 86 has an annular lip 92 that rests on top of the housing vent section flange 46, thereby mounting the cap 86 on the vent section 16 for rotation of the cap relative to the vent section. Pressing the vent section 16, with the cap 86 mounted on the section, into the housing pump section 14 interconnects the vent section ridges 38 with the pump section ribs 26. This attaches the housing vent section 16 to the housing pump section 14 with the cap 86 mounted on the housing for rotation of the cap on the trigger sprayer 12. The cap 86 is provided with internal screw threading on the interior surface of the cap sidewall 88 for attaching the trigger sprayer 12 to the neck of a liquid container in the conventional manner. Other means may be provided on the cap 86 for attaching the trigger sprayer 12 to the liquid container.

With the trigger sprayer 12 attached to the liquid container, the gasket 74 is positioned to seal between the container neck and the housing vent section annular surface 52. The gasket 74 also extends over the membrane 66, providing additional protection to the membrane 66. The posts 72 extending into the gasket 74 secure the gasket in position on the trigger sprayer 12.

The novel configurations of the trigger sprayer vent section 16 and gasket 74 provides the trigger sprayer 12 with a passive venting system of simplified and inexpensive construction. The membrane 66 over the vent opening 64 prevents the leakage of liquid from the container through the trigger sprayer, while allowing the venting of air from the exterior environment of the trigger sprayer to the container interior. The positioning of the vent opening surface 54 inside the vent side wall 56 protects the membrane 66 from becoming separated from the trigger sprayer by contacting other trigger sprayers during manufacturing or shipment. Thus, the combination of these features provides a trigger sprayer that is economically manufactured, provides a fluid tight seal between the trigger sprayer and the liquid container, and prevents the leakage of liquid from the container while allowing venting of the container.

Although the trigger sprayer with the venting membrane in a protective housing cavity has been described above by reference to a particular embodiment of the invention, it should be understood that other variations and modifications could be made to the venting system of the invention without departing from the intended scope of the following claims. For example, the venting system with the membrane 66 positioned in a recessed cavity defined by a vent side wall 56 can be used in other types of dispensers attached to liquid containers, for example vertically reciprocating pump dispensers. In addition, the dispensers could have one piece constructions in lieu of the two piece housing construction described herein.

What is claimed is:

1. A manually operated liquid dispensing apparatus comprising:

a housing having a manually operated pump;

a liquid supply passage extending through the housing to the pump for communicating the pump with a liquid container attached to the housing;

a liquid discharge passage extending through the housing from the pump for communicating the pump with an exterior of the housing for discharging liquid from the housing on operation of the pump;

a vent opening in the housing for venting the exterior of the housing to the liquid container attached to the housing;

a side wall on the housing extending around the vent opening; and, a membrane positioned against the housing covering over the vent opening and inside the housing side wall whereby the housing side wall provides protection to the membrane.

2. The apparatus of claim 1, further comprising:

the membrane being a gas permeable, liquid impermeable membrane.

3. The apparatus of claim 2, further comprising:

a vent surface on the housing;

the vent opening passing through the vent surface; and, the membrane being secured to the vent surface.

4. The apparatus of claim 3, further comprising:

the housing side wall extending outwardly from the vent surface.

5. The apparatus of claim 4, further comprising:

the side wall extending outwardly from the vent surface to an end edge of the side wall; and, a gasket engaging against the end edge of the side wall.

6. The apparatus of claim 5, further comprising:

the gasket engaging against the housing and the liquid container attached to the housing to provide a seal between the housing and the liquid container.

7. A apparatus of claim 5, further comprising:

a bypass opening in the side wall that communicates the vent opening with an interior of the liquid container attached to the housing by bypassing the gasket.

8. A manually operated liquid dispensing apparatus comprising:

a housing having a manually operated pump;

a liquid supply passage extending through the housing for communicating the pump with a liquid container attached to the housing;

a liquid discharge passage extending through the housing for communicating the pump with an exterior of the housing for discharging liquid from the housing on operation of the pump;

a vent surface on the housing;

a vent opening through the vent surface and communicating with the housing exterior;

a side wall projecting outwardly from the vent surface and extending around the vent opening; and, a membrane positioned against the vent surface and covering over the vent opening with the side wall extending around the membrane and protecting the membrane.

9. The apparatus of claim 8, further comprising:

the membrane being a gas permeable, liquid impermeable membrane.

10. The apparatus of claim 9, further comprising:

the membrane having a peripheral edge; and, the side wall having a configuration on the vent surface that follows the membrane peripheral edge.

11. The apparatus of claim 9, further comprising:

the membrane having a circular peripheral edge; and, the side wall being cylindrical.

12. The apparatus of claim 9, further comprising:

a gasket that provides a seal between the housing and a liquid container attached to the housing; and, the side wall having an edge that engages with the gasket.

13. The apparatus of claim 12, further comprising:

the housing having an annular sealing surface that engages with the gasket.

14. A manually operated liquid dispensing apparatus comprising:

a housing having a manually operated pump;

a liquid supply passage extending through the housing for communicating the pump with a liquid container attached to the housing;

a liquid discharge passage extending through the housing for communicating the pump with an exterior of the housing for discharging liquid from the housing on operation of the pump;

a vent surface on the housing;

a vent opening through the vent surface and communicating with the housing exterior;

a side wall projecting outwardly from the vent surface and extending around the vent opening;

a membrane covering over the vent opening with the side wall extending around the membrane and protecting the membrane;

the membrane being a gas permeable, liquid impermeable membrane;

the vent surface being a flat surface;

the membrane being secured to the vent surface; and, the side wall extending around the membrane in close proximity to the membrane.

15. A manually operated liquid dispensing apparatus comprising:

a housing having a manually operated pump;

a liquid supply passage extending through the housing for communicating the pump with a liquid container attached to the housing;

a liquid discharge passage extending through the housing for communicating the pump with an exterior of the housing for discharging liquid from the housing on operation of the pump;

a vent surface on the housing;

a vent opening through the vent surface and communicating with the housing exterior;

a side wall projecting outwardly from the vent surface and extending around the vent opening;

a membrane covering over the vent opening with the side wall extending around the membrane and protecting the membrane;

the membrane being a gas permeable, liquid impermeable membrane;

a gasket that provides a seal between the housing and the liquid container attached to the housing; and, the side wall edge having a bypass opening that bypasses the engagement of the side wall with the gasket.

16. A manually operated liquid dispensing apparatus comprising:

a housing having a manually operated pump;

the liquid supply passage extending through the housing to the pump for communicating the pump with a liquid container attached to the housing;

a liquid discharge passage extending through the housing from the pump and communicating with an exterior of the housing for discharging liquid from the housing on operation of the pump;

an annular sealing surface on the housing;

a cavity recessed into the housing from the annular sealing surface;

a vent surface inside the cavity and spaced by the cavity from the sealing surface;

a vent opening in the vent surface, the vent opening communicating the housing exterior with an interior of a container attached to the housing; and, a membrane positioned inside the cavity covering the vent opening.

17. The apparatus of claim 16, further comprising:

the membrane being a gas permeable, liquid impermeable membrane.

18. The apparatus of claim 17, further comprising:

the cavity being a cylindrical cavity and the membrane having a circular peripheral edge.

19. The apparatus of claim 17, further comprising:

a side wall extending around the vent opening and defining the cavity, the side wall being positioned inside the annular sealing surface.

20. A manually operated liquid dispensing apparatus comprising:

a housing having a manually operated pump;

a liquid supply passage extending through the housing to the pump for communicating the pump with a liquid container attached to the housing;

a liquid discharge passage extending through the housing from the pump and communicating with an exterior of the housing for discharging liquid from the housing on operation of the pump;

an annular sealing surface on the housing;

a cavity recessed into the housing from the annular sealing surface;

a vent surface inside the cavity and spaced by the cavity from the sealing surface;

a vent opening in the vent surface, the vent opening communicating the housing exterior with an interior of the container attached to the housing;

a membrane positioned inside the cavity covering the vent opening;

the membrane being a gas permeable, liquid impermeable membrane; and a gasket engaging with the annular sealing surface and providing a seal between the housing and the liquid container attached to the housing, the gasket covering over the cavity.

* * * * *